US006777097B2

(12) United States Patent
Hamada et al.

(10) Patent No.: US 6,777,097 B2
(45) Date of Patent: Aug. 17, 2004

(54) CORROSION RESISTANT RARE EARTH MAGNET AND ITS PREPARATION

(75) Inventors: Ryuji Hamada, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 37 days.

(21) Appl. No.: 10/170,448

(22) Filed: Jun. 14, 2002

(65) Prior Publication Data

US 2003/0079805 A1 May 1, 2003

(30) Foreign Application Priority Data

Jun. 14, 2001 (JP) ..... 2001-179533

(51) Int. Cl.[7] ..... B22B 9/00

(52) U.S. Cl. ..... 428/469; 428/327; 428/328; 428/330; 428/331; 428/332; 428/447; 428/450; 427/127; 148/101; 148/302; 148/102; 148/104

(58) Field of Search ..... 148/101, 102, 148/104, 302; 427/127; 428/327, 328, 330, 331, 332, 447, 450, 469

(56) References Cited

U.S. PATENT DOCUMENTS 6,224,986 B1 * 5/2001 Minowa et al. ..... 428/469
6,251,981 B1 * 6/2001 Tanaka et al. ..... 524/457

FOREIGN PATENT DOCUMENTS

EP 1 024 506 A 8/2000
JP 3-99406 * 4/1991 ..... 427/435
JP 4-62903 * 2/1992 ..... 428/220
JP 5-21218 A 1/1993
JP 5-21219 1/1993
JP 5-74618 A 3/1993
JP 5-182814 A 7/1993
JP 8-186016 * 7/1996
JP 10-226890 * 8/1998
JP 2853838 B2 11/1998
JP 2853839 B2 11/1998
JP 11-3811 * 1/1999

OTHER PUBLICATIONS

Toda Kogyo Corp., Patent Abstracts of Japan, vol. 013, No. 410, Sep. 11, 1989, abstract of JP 01 149403 A.

Sumitomo Special Metals Co., Database WPI, Section Ch, Week 198842, Derwent Publications Ltd., JP 63–217601A, XP002222538.

* cited by examiner

*Primary Examiner*—John P. Sheehan
(74) *Attorney, Agent, or Firm*—Birch, Stewart, Kolasch & Birch, LLP

(57) ABSTRACT

On a surface of a rare earth permanent magnet R—T—M—B wherein R is a rare earth element, T is Fe or Fe and Co, M is Ti, Nb, Al, V, Mn, Sn, Ca, Mg, Pb, Sb, Zn, Si, Zr, Cr, Ni, Cu, Ga, Mo, W or Ta, 5 wt %≦R≦40 wt %, 50 wt %≦90 wt %, 0 wt %≦M≦8 wt %, and 0.2 wt %≦B≦8 wt %, a solution comprising a flake fine powder of Al, Mg, Ca, Zn, Si, Mn or an alloy thereof and a silicone resin is applied and baked to form an adherent composite coating, thereby providing a corrosion resistant rare earth permanent magnet.

5 Claims, No Drawings

CORROSION RESISTANT RARE EARTH MAGNET AND ITS PREPARATION

This invention relates to a corrosion resistant rare earth magnet and a method for preparing the same.

BACKGROUND OF THE INVENTION

Because of their excellent magnetic properties, rare earth permanent magnets are frequently used in a wide variety of applications such as electric apparatus and computer peripheral devices and are important electric and electronic materials. In particular, a family of Nd—Fe—B permanent magnets has lower starting material costs than Sm—Co permanent magnets because the key element neodymium exists in more plenty than samarium and the content of cobalt is low. This family of magnets also has much better magnetic properties than Sm—Co permanent magnets, making them excellent as permanent magnet materials. For this reason, the demand for Nd—Fe—B permanent magnets is recently increasing and the application thereof is spreading.

However, the Nd—Fe—B permanent magnets have the drawback that they are readily oxidized in humid air within a short time since they contain rare earth elements and iron as the main components. When Nd—Fe—B permanent magnets are incorporated in magnetic circuits, the oxidation phenomenon raises such problems as decreased outputs of magnetic circuits and contamination of the associated equipment with rust.

In the last decade, Nd—Fe—B permanent magnets find incipient use in motors such as automotive motors and elevator motors. The magnets are inevitably used in a hot humid environment. In some potential situations, the magnets are exposed to salt-containing moist air. It would be desirable if magnets are endowed with corrosion resistance at low cost. In the motors, the magnets can be heated at 300° C. or higher, though for a short time, in their manufacturing process. In this application, the magnets are also required to have heat resistance.

To improve the corrosion resistance of Nd—Fe—B permanent magnets, various surface treatments such as resin coating, aluminum ion plating and nickel plating are often implemented. It is difficult for these surface treatments of the state-of-the-art to accommodate the above-mentioned rigorous conditions. For example, resin coating provides insufficient corrosion resistance and lacks heat resistance. Nickel plating allows the underlying material to rust in salt-containing moist air because of the presence of some pinholes. The ion plating technique achieves generally satisfactory heat resistance and corrosion resistance, but needs a large size apparatus and is thus difficult to conduct at low cost.

SUMMARY OF THE INVENTION

An object of the present invention is to provide an R—T—M—B rare earth permanent magnet such as a neodymium magnet which can withstand use under rigorous conditions as mentioned above, and more particularly, a corrosion resistant rare earth magnet which is arrived at by providing the magnet with a corrosion and heat-resistant coating. Another object is to provide a method for preparing the corrosion resistant rare earth magnet.

According to the invention, a rare earth permanent magnet represented by R—T—M—B wherein R, T and M are as defined below is treated on a surface thereof with a solution of a flake fine powder of a specific metal or alloy and a silicone resin by dipping the magnet in the solution or by coating the solution to the magnet. Subsequent heating forms on the magnet surface a composite coating in which the flake fine powder is bound with an oxidized product of the silicone resin such as silica. A highly corrosion resistant rare earth magnet is obtained in this way. The conditions necessary to achieve the object have been established.

In a first aspect, the present invention provides a corrosion resistant rare earth magnet comprising a rare earth permanent magnet represented by R—T—M—B wherein R is at least one rare earth element inclusive of yttrium, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and B is boron, the contents of the respective elements are 5 wt %≦R≦40 wt %, 50 wt %≦T≦90 wt %, 0 wt %≦M≦8 wt %, and 0.2 wt %≦B≦8 wt %, and a composite coating formed on a surface of the permanent magnet by treating the permanent magnet with a solution comprising at least one flake fine powder selected from the group consisting of Al, Mg, Ca, Zn, Si, Mn and alloys thereof and a silicone resin, followed by heating.

In a second aspect, the present invention provides a method for preparing a corrosion resistant rare earth magnet comprising the steps of providing a rare earth permanent magnet represented by R—T—M—B wherein R is at least one rare earth element inclusive of yttrium, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and B is boron, the contents of the respective elements are 5 wt %≦R≦40 wt %, 50 wt %≦T≦90 wt %, 0 wt %≦M≦8 wt %, and 0.2 wt %≦B≦8 wt %; treating a surface of the permanent magnet with a solution comprising at least one flake fine powder selected from the group consisting of Al, Mg, Ca, Zn, Si, Mn and alloys thereof and a silicone resin; and heating the treated permanent magnet to form a composite coating on the permanent magnet.

DESCRIPTION OF THE PREFERRED EMBODIMENTS

The present invention starts with rare earth permanent magnets represented by R—T—M—B, such as Ne—Fe—B base permanent magnets. Herein R represents at least one rare earth element inclusive of yttrium, preferably Nd or a combination of major Nd with another rare earth element or elements. T represents Fe or a mixture of Fe and Co. M represents at least one element selected from among Ti, Nb, Al, V, Mn, Sn, Ca, Mg, Pb, Sb, Zn, Si, Zr, Cr, Ni, Cu, Ga, Mo, W, and Ta. B is boron. The contents of the respective elements are 5 wt %≦R≦40 wt %, 50 wt %≦T≦90 wt %, 0 wt %≦M≦8 wt %, and 0.2 wt %≦B≦8 wt %.

More particularly, R represents a rare earth element inclusive of yttrium, and specifically, at least one element selected from among Y, La, Ce, Pr, Nd, Sm, Eu, Gd, Tb, Dy, Ho, Er, Tm, Yb, and Lu. R should preferably include Nd. The content of R is 5% to 40% by weight and preferably 10 to 35% by weight of the magnet.

T represents Fe or a mixture of Fe and Co. The content of T is 50% to 90% by weight and preferably 55 to 80% by weight of the magnet.

M represents at least one element selected from among Ti, Nb, Al, V, Mn, Sn, Ca, Mg, Pb, Sb, Zn, Si, Zr, Cr, Ni, Cu, Ga, Mo, W, and Ta. The content of M is 0% to 8% by weight and preferably 0 to 5% by weight of the magnet.

The content of boron (B) is 0.2% to 8% by weight and preferably 0.5 to 5% by weight of the sintered magnet.

For the preparation of R—T—M—B permanent magnets such as Nd—Fe—B base permanent magnets, raw metal materials are first melted in vacuum or an atmosphere of an inert gas, preferably argon to form an ingot. Suitable raw metal materials used herein include pure rare earth elements, rare earth alloys, pure iron, ferroboron, and alloys thereof, which are understood to contain various impurities which incidentally occur in the industrial manufacture, typically C, N, O, H, P, S, etc. If necessary, solution treatment is carried out on the ingot because α-Fe, R-rich and B-rich phases may sometimes be left in the alloy as well as the $R_2Fe_{14}B$ phase. To this end, heat treatment may be carried out in vacuum or in an inert atmosphere of Ar or the like, at a temperature of 700 to 1,200° C. for a time of 1 hour or more.

The ingot thus obtained is crushed, then milled, preferably to an average particle size of 0.5 to 20 μm. Particles with an average particle size of less than 0.5 μm are rather vulnerable to oxidation and may lose magnetic properties. Particles with an average particle size of more than 20 μm may be less sinterable.

The powder is press molded in a magnetic field into a desired shape, which is then sintered. Sintering is generally conducted at a temperature in the range of 900 to 1,200° C. in vacuum or an inert atmosphere such as Ar, for a period of 30 minutes or more. The sintering is usually followed by aging treatment at a lower temperature than the sintering temperature for a period of 30 minutes or more.

The method of preparing the magnet is not limited to the aforementioned one. A so-called two-alloy method is also useful which involves mixing alloy powders of two different compositions and sintering the mixture to produce a high performance Nd magnet. Japanese Patent Nos. 2,853,838 and 2,853,839, JP-A 5-21218, JP-A 5-21219, JP-A 5-74618, and JP-A 5-182814 teach methods involving the steps of determining the composition of two alloys in consideration of the type and properties of magnet material constituent phase, and combining them to produce a high performance Nd magnet having a good balance of high remanence, high coercivity and high energy product. Any of these methods may be employed in the present invention.

Although the permanent magnet used in the invention contains impurities which are incidentally entrained in the industrial manufacture, typically C, N, O, H, P, S, etc., it is desirable that the total content of such impurities be 2% by weight or less. An impurity content of more than 2 wt % means the inclusion of more non-magnetic components in the permanent magnet, which may lead to a lower remanence. Additionally, the rare earth element is consumed by the impurities, with a likelihood of under-sintering, leading to a lower coercivity. The lower the total impurity content, the better becomes the magnet (including a higher remanence and a higher coercivity).

According to the invention, a composite coating is formed on a surface of the permanent magnet by heating a coating of a solution comprising a flake fine powder and a silicone resin.

The flake fine powder used herein is of a metal selected from among Al, Mg, Ca, Zn, Si, and Mn, or an alloy or mixture of two or more of the foregoing metal elements. It is preferable to use a metal selected from among Al, Zn, Si and Mn. As to the shape of the flake fine powder, the powder preferably consists of flakes having an average length of 0.1 to 15 μm, an average thickness of 0.01 to 5 μm, and an aspect ratio of at least 2. The "aspect ratio" as used herein is defined as average length divided by average thickness. More preferably the flakes have an average length of 1 to 10 μm, an average thickness of 0.1 to 0.3 μm, and an aspect ratio of at least 10. With an average length of less than 0.1 μm, flakes may not pile up parallel to the underlying magnet, probably leading to a loss of adhesive force. With an average length of more than 15 μm, flakes may be lifted up by evaporating a solvent of the coating solution during the heating or baking step so that they do not stack parallel to the underlying magnet, resulting in a less adherent coating. The average length of not more than 15 μm is also desirable from the dimensional precision of the coating. Flakes with an average thickness of less than 0.01 μm can be oxidized on their surface during their preparation stage, resulting in a coating which is brittle and less resistant to corrosion. Flakes with an average thickness of more than 5 μm become difficult to disperse in a coating solution and tend to settle down in the solution, which becomes unstable, with a likelihood of poor corrosion resistance. With an aspect ratio of less than 2, flakes may not stack parallel to the underlying magnet, resulting in a less adherent coating. The upper limit of the aspect ratio is not critical. However, the aspect ratio is usually up to 100 since flakes having too high an aspect ratio are economically undesired.

Suitable silicone resins for use in the coating solution include, but are not limited thereto, silicone resins such as methylsilicone resins and methylphenyl-silicone resins, and modified silicone resins, that is, silicone resins modified with various organic resins, such as, for example, silicone polyesters, silicone epoxy resins, silicone alkyd resins, and silicone acrylic resins. These resins may be used in the form of silicone varnish or the like. It is noted that these silicone resins or silicone varnishes are commercially available.

The solvent of the coating solution is water or an organic solvent. In the coating solution, the concentrations of the flake fine powder and the silicone resin are selected so that the flake fine powder is contained in the concentration described later in the composite coating.

In preparing the coating solution, various additives such as dispersants, anti-settling agents, thickeners, anti-foaming agents, anti-skinning agents, drying agents, curing agents and anti-sagging agents may be added in an amount of at most 10% by weight for the purpose of improving the performance thereof.

According to the invention, the magnet is dipped in the coating solution or coated with the coating solution, followed by heat treatment for curing. The dipping and coating techniques are not critical. Any well-known technique may be used to form a coating of the coating solution on a surface of the magnet. Desirably, a heating temperature of from 200° C. to less than 350° C. is maintained for 30 minutes or more in vacuum, air or an inert gas atmosphere. A temperature below 200° C. may induce under-curing, with probable losses of adhesion and corrosion resistance. A temperature of 350° C. or higher can damage the underlying magnet, detracting from its magnetic properties. The upper limit of the heating time is not critical although one hour is usually sufficient.

In forming the composite coating, the application of the coating solution followed by heat treatment may be repeated.

At the end of heat treatment, the coating of the coating solution assumes the structure in which the fine powder flakes are bound with the silicone resin. Although the reason why the composite coating exhibits high corrosion resistance is not well understood, it is believed that the fine powder flakes are oriented substantially parallel to the underlying magnet and thus fully cover the magnet, achieving good shielding effects. When the flake fine powder used is made of a metal or alloy having a more negative potential than the permanent magnet, presumably the flake fine powder is oxidized in advance, protecting the underlying magnet from oxidation. Additionally, the coating formed contains much inorganic matter and is more resistant to heat than organic coatings.

It is believed that during the heat treatment, the silicone resin is gradually decomposed and evaporated and eventually converted into silica. Therefore, the composite coating is believed to consist essentially of the flake fine powder and the oxidized product of the silicone resin due to the oxidation of the silicone resin and/or the residual silicone resin. The oxidized product of the silicone resin includes silica and/or silica precursor (partially oxidized product of the silicone resin).

In the composite coating, the flake fine powder is preferably included in an amount of at least 30% by weight, preferably at least 35% by weight, more preferably at least 40% by weight. The upper limit of the flake fine powder amount may preferably be up to 95% by weight. A fine powder content of less than 30 wt % is sometimes too small for flakes to fully cover the magnet surface, leading to poor corrosion resistance.

The composite coating desirably has an average thickness of 1 to 40 μm, and more desirably 5 to 25 μm. A coating of less than 1 μm may be short of corrosion resistance whereas a coating of more than 40 μm may tend to incur adhesion decline or delamination. A thicker coating has a possibility that even if the outer shape of coated magnet remains the same, the effective volume of R—Fe—B base permanent magnet becomes reduced, which is inconvenient to the use of the magnet.

In the practice of the invention, pretreatment may be carried out on the surface of the magnet prior to the provision of the composite coating. Suitable pretreatment is at least one of pickling, caustic cleaning and shot blasting. More specifically, the pretreatment is selected from (1) pickling, rinsing and ultrasonic cleaning, (2) caustic cleaning and rinsing, and (3) shot blasting. Suitable cleaning fluid for use in (1) is an aqueous solution containing 1 to 20% by weight of at least one acid selected from nitric acid, hydrochloric acid, acetic acid, citric acid, formic acid, sulfuric acid, hydrofluoric acid, permanganic acid, oxalic acid, hydroxyacetic acid, and phosphoric acid. The fluid is heated at room temperature to 80° C. before the rare earth magnet is dipped therein. The pickling removes the oxides on the magnet surface and facilitates adhesion of the composite coating to the surface. Suitable caustic cleaning fluid for used in (2) is an aqueous solution containing 5 to 200 g/liter of at least one agent selected from sodium hydroxide, sodium carbonate, sodium orthosilicate, sodium metasilicate, trisodium phosphate, sodium cyanate and chelating agents. The fluid is heated at room temperature to 90° C. before the rare earth magnet is dipped therein. The caustic cleaning removes oil and fat contaminants on the magnet surface, eventually increasing the adhesion between the composite coating and the magnet. Suitable blasting agents for use in (3) include ceramics, glass and plastics. An injection pressure of 2 to 3 kgf/cm$^2$ is effective. The shot blasting removes the oxides on the magnet surface on dry basis and facilitates adhesion of the composite coating as well.

EXAMPLE

Examples of the invention are given below by way of illustration and not by way of limitation.

Examples & Comparative Examples

By high-frequency melting in an Ar atmosphere, an ingot having the composition 32Nd-1.2B-59.8Fe-7Co was prepared. The ingot was crushed by a jaw crusher, then milled in a jet mill using nitrogen gas, obtaining a fine powder having an average particle size of 3.5 μm. The fine powder was contained in a mold across which a magnetic field of 10 kOe was applied, and molded under a pressure of 1.0 t/cm$^2$. The compact was sintered in vacuum at 1,100° C. for 2 hours, then aged at 550° C. for one hour, obtaining a permanent magnet. From the permanent magnet, a magnet button having a diameter of 21 mm and a thickness of 5 mm was cut out. After barrel polishing and ultrasonic cleaning, it was ready for use as a test piece.

A coating solution was furnished by dispersing aluminum flakes and zinc flakes in a silicone varnish. In this case, the coating solution was prepared so that the composite coating obtained from the coating solution contained 8% by weight of aluminum flakes having an average length of 3 μm and an average thickness of 0.2 μm and 80% by weight of zinc flakes having an average length of 3 μm and an average thickness of 0.2 μm (88% by weight of the total amount of the aluminum flakes and zinc flakes). The coating solution was sprayed to the test piece so as to provide a predetermined coating thickness by means of a spray gun, and heated in air at 300° C. for 30 minutes through a hot air drier. In this way, a composite coating was formed on the test piece, which was subjected to the following performance tests. The resulting composite coating contained the above-described contents of the aluminum and zinc flakes and the balance of silica derived from the complete oxidation of the silicone varnish and partially oxidized product of the silicone varnish.

(1) Crosscut Adhesion Test

According to the crosscut test of JIS K-5400, the coating was scribed with a cutter knife in orthogonal directions to define 100 sections of 1 mm square. Adhesive tape (Cellotape®) was firmly attached to the crosscut coating and strongly pulled back at an angle of 45 degrees for peeling. Adhesion is evaluated in terms of the number of sections left unstrapped.

(2) Salt Spray Test

According to the neutral salt spray (NSS) test of JIS Z-2371, 5% saline was continuously sprayed at 35° C. Corrosion resistance is evaluated in terms of the time passed until brown rust generated.

Examples 1–2 & Comparative Examples 1–4

Coatings of 10 μm thick were formed on the test pieces by spraying the coating solutions through a spray gun. Examples 1 and 2 used Straight Silicone Varnish KR-271 and Polyester Silicone Varnish KR-5230, respectively, both available from Shin-Etsu Chemical Co., Ltd.

For comparison purposes, coatings of 10 μm thick were formed on the test pieces by aluminum ion plating, nickel plating and epoxy resin coating. These samples were also subjected to the NSS test.

In a heat resistance test, the samples were heated at 350° C. for 4 hours, and any appearance change on the coatings was visually observed. The results are also shown in Table 1. It is evident that the permanent magnets treated according to the invention have both corrosion resistance and heat resistance as compared with the otherwise surface treated permanent magnets.

TABLE 1

| | Surface treatment | NSS test, hr | Appearance of coating after 350° C./4 hr heating |
|---|---|---|---|
| Comparative Example 1 | none | 4 | rust over entire surface |

TABLE 1-continued

| | Surface treatment | NSS test, hr | Appearance of coating after 350° C./4 hr heating |
|---|---|---|---|
| Comparative Example 2 | Al ion plating | 200 | no change |
| Comparative Example 3 | Ni plating | 50 | discolored, partially crazed |
| Comparative Example 4 | resin coating | 100 | carbonized, partially melted |
| Example 1 | composite coating | 1,000 | no change |
| Example 2 | composite coating | 1,000 | no change |

Examples 3–7

Samples were prepared as in Example 1 aside from varying the thickness of coating. They were examined by the crosscut adhesion test and the NSS test. The coating solution used was the same as in Example 1. The results are shown in Table 2. The results indicate the tendency that too thin a coating is short of corrosion resistance and too thick a coating is less adherent.

TABLE 2

| | Average coating thickness, μm | NSS test, hr | Crosscut adhesion test |
|---|---|---|---|
| Example 3 | 0.5 | 50 | 100/100 |
| Example 4 | 1.0 | 500 | 100/100 |
| Example 5 | 10 | 1,000 | 100/100 |
| Example 6 | 40 | 2,000 | 100/100 |
| Example 7 | 50 | 2,000 | 80/100 |

Examples 8–10

Samples were prepared as in Example 1 aside from varying the content of flake fine powder in the coating. They were examined by the NSS test. The flake fine powder in the coating solution was a mixture of aluminum flakes and zinc flakes both having an average length of 3 μm and an average thickness of 0.2 μm in a weight ratio of 1:10. The concentration of the powder mixture in the coating solution was adjusted such that the content of flake fine powder in the coating was as shown in Table 3. The balance was silica and the partially oxidized product of the silicone varnish. The coating thickness was 10 μm. The results are shown in Table 3. The results indicate the tendency that too low a content of flake fine powder in the coating worsens corrosion resistance.

TABLE 3

| | Content of flake powder in coating, wt % | NSS test, hr |
|---|---|---|
| Example 8 | 25 | 50 |
| Example 9 | 60 | 500 |
| Example 10 | 90 | 1,000 |

Examples 11–23

Samples were prepared as in Example 1 aside from varying the shape of flake fine powder (i.e., average length, average thickness and aspect ratio of flake particles). They were examined by the crosscut adhesion test and the NSS test. The coating thickness was 10 μm. The results are shown in Table 4. It is evident from Examples 11–15 that the adhesion of coatings may degrade when the average length is too small or too large. It is evident from Examples 16–20 that the corrosion resistance of coatings may degrade when the average thickness is too small or too large. Examples 21–23 indicate that too low an aspect ratio may lead to poor adhesion.

TABLE 4

| | Average length, μm | Average thickness, μm | Aspect ratio | NSS test, hr | Crosscut adhesion test |
|---|---|---|---|---|---|
| Example 11 | 0.05 | 0.01 | 5 | 1,000 | 80/100 |
| Example 12 | 0.1 | 0.02 | 5 | 1,000 | 100/100 |
| Example 13 | 2 | 0.2 | 10 | 1,000 | 100/100 |
| Example 14 | 15 | 0.5 | 30 | 1,000 | 100/100 |
| Example 15 | 20 | 0.5 | 40 | 1,000 | 80/100 |
| Example 16 | 0.1 | 0.005 | 20 | 500 | 100/100 |
| Example 17 | 0.1 | 0.01 | 10 | 1,000 | 100/100 |
| Example 18 | 2 | 0.2 | 10 | 1,000 | 100/100 |
| Example 19 | 15 | 5 | 3 | 1,000 | 100/100 |
| Example 20 | 15 | 6 | 2.5 | 500 | 100/100 |
| Example 21 | 0.75 | 0.5 | 1.5 | 1,000 | 80/100 |
| Example 22 | 1.0 | 0.5 | 2 | 1,000 | 100/100 |
| Example 23 | 10 | 0.5 | 20 | 1,000 | 100/100 |

Examples 24–27

Permanent magnet samples were prepared as in Example 1 except that the test piece was subjected to the pretreatment described below before a coating solution of aluminum flakes and zinc flakes dispersed in silicone varnish was coated and heated at 350° C. for 30 minutes.

Pickling composition:
- 10 v/v % nitric acid
- 5 v/v % sulfuric acid dipped at 50° C. for 30 seconds Caustic Cleaning composition:
- 10 g/l sodium hydroxide
- 3 g/l sodium metasilicate
- 10 g/l trisodium phosphate
- 8 g/l sodium carbonate
- 2 g/l surfactant dipped at 40° C. for 2 minutes Shot Blasting
- #220 aluminum oxide grits
- injection pressure 2 kgf/cm$^2$ The coated magnet samples were subjected to a pressure cooker test (PCT) of 120° C., 2 atm., 200 hours and then to a crosscut adhesion test. According to the crosscut test of JIS K-5400, the coating was scribed with a cutter knife in orthogonal directions to define 100 sections of 1 mm square. Adhesive tape (Cellotape®) was firmly attached to the crosscut coating and strongly pulled back at an angle of 45 degrees for peeling. Adhesion is evaluated in terms of the number of sections left unstrapped. The results are shown in Table 5. It is seen that the pretreatment of magnet pieces facilitates adhesion.

TABLE 5

| | Pretreatment | Crosscut adhesion test after PCT |
|---|---|---|
| Example 24 | none | 80/100 |
| Example 25 | pickling + rinsing + ultrasonic cleaning | 100/100 |
| Example 26 | caustic cleaning + rinsing | 100/100 |
| Example 27 | shot blasting | 100/100 |

According to the invention, a rare earth permanent magnet is provided on its surface with a composite coating of flakes of Al, Mg, Ca, Zn, Si, Mn or an alloy thereof and oxidized product of silicone resin. The composite coating is highly adherent to the underlying magnet and a corrosion resistant permanent magnet is manufactured at a low cost. The invention is of great worth in the industry.

Japanese Patent Application No. 2001-179533 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A corrosion resistant rare earth magnet comprising a rare earth permanent magnet represented by R—T—M—B wherein R is at least one rare earth element inclusive of yttrium, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and B is boron, the contents of the respective elements are 5 wt %≦R≦40 wt %, 50 wt %≦T≦90 wt %, 0 wt %≦M≦8 wt %, and 0.2 wt %≦B≦8 wt %, and a composite coating formed on a surface of the permanent magnet by treating the permanent magnet with a solution comprising at least one flake fine powder selected from the group consisting of Al, Mg, Ca, Zn, Si, Mn and alloys thereof and a silicone resin, followed by heating.

2. The rare earth magnet of claim 1 wherein the composite coating has an average thickness of 1 to 40 μm.

3. The rare earth magnet of claim 1 wherein the flake fine powder in the composite coating consists of metal or alloy particles having an average length of 0.1 to 15 μm, an average thickness of 0.01 to 5 μm, and an aspect ratio, given as average length divided by average thickness, of at least 2, and the flake fine powder accounts for at least 30 wt % of the composite coating.

4. A method for preparing a corrosion resistant rare earth magnet comprising the steps of:

providing a rare earth permanent magnet represented by R—T—M—B wherein R is at least one rare earth element inclusive of yttrium, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and B is boron, the contents of the respective elements are 5 wt %≦R≦40 wt %, 50 wt %≦T≦90 wt %, 0 wt %≦M≦8 wt %, and 0.2 wt %≦B≦8 wt %, treating a surface of the permanent magnet with a solution comprising at least one flake fine powder selected from the group consisting of Al, Mg, Ca, Zn, Si, Mn and alloys thereof and a silicone resin, and heating the treated permanent magnet to form a composite coating on the permanent magnet.

5. The method of claim 4 further comprising the step of subjecting a surface of the permanent magnet to at least one pretreatment selected from among pickling, caustic cleaning and shot blasting, prior to the treating step.

* * * * *